US005427541A

United States Patent [19]

Calio

[11] Patent Number: 5,427,541

[45] Date of Patent: Jun. 27, 1995

[54] COMPLIANT ELECTRICAL CONNECTOR AND A SOCKET ASSEMBLY THEREFOR

[75] Inventor: Nicholas A. Calio, Doylestown, Pa.

[73] Assignee: Rocal Corporation, Warrington, Pa.

[21] Appl. No.: 203,330

[22] Filed: Feb. 28, 1994

[51] Int. Cl.[6] ..... H01R 13/64

[52] U.S. Cl. ..... 439/246

[58] Field of Search ..... 439/246, 252

[56] References Cited

U.S. PATENT DOCUMENTS 2,681,441 6/1954 Linn .

2,702,376 2/1955 Brush ..... 439/252

FOREIGN PATENT DOCUMENTS 107472 11/1924 Switzerland ..... 439/246

326165 2/1930 United Kingdom ..... 439/252

*Primary Examiner*—Eugene F. Desmond

*Attorney, Agent, or Firm*—David L. Davis

[57] ABSTRACT

An electrical connector assembly which is adaptive to accommodate variations in the diameters of, and in the spacing between, pins with which it mates. The sockets of the assembly are formed with elongated fingers which deflect for larger diameter pins and are mounted to the connector housing in such a way that they have limited freedom of movement orthogonally to the longitudinal axes of the sockets to accept variations in the pin spacing.

8 Claims, 4 Drawing Sheets

COMPLIANT ELECTRICAL CONNECTOR AND A SOCKET ASSEMBLY THEREFOR

BACKGROUND OF THE INVENTION

This invention relates to electrical connector assemblies for mating with conductive pins of a complementary connector and, more particularly, to such an assembly which is adaptive to accommodate variations in the spacing between, and in the diameters of, the pins.

It is common in aircraft to provide a "quick disconnect" electrical connector assembly attached to a wiring harness for mating with a complementary receptacle, or connector, secured to the aircraft battery. The quick disconnect feature provides an effective way by which the battery may be disconnected so that it can be removed from the aircraft for maintenance and/or repair and then readily reconnected after such maintenance and/or repair. Typically, the receptacle which is secured to the battery has two conductive pins molded in a plastic housing, with the two pins having a fixed nominal spacing therebetween and being of a specified nominal diameter. These two pins are respectively connected to the positive and negative terminals of the battery.

The connector assembly which engages the receptacle includes two female sockets which receive the two pins of the receptacle to provide a low resistance electrical connection therewith. When designing such a connector assembly, numerous requirements must be satisfied. Some of these requirements are as follows:

A. the sockets must accommodate, within prescribed limits, variations in the spacing between the mating receptacle pins;

B. the sockets must accommodate, within prescribed limits, variations in the diameters of the mating receptacle pins;

C. the sockets must be able to withstand relative motion of the mating receptacle that may occur during structural or dynamic loading;

D. the pins of the receptacle must enter the sockets with a low insertion force; and E. the sockets must maintain good electrical contact with the mating receptacle pins after several thousand insertions and throughout the operating life of the parts.

It is therefore a primary object of the present invention to provide an electrical connector assembly which satisfies all of the above requirements.

SUMMARY OF THE INVENTION

The foregoing and additional objects are attained in accordance with the principles of this invention by providing a dimensional tolerant electrical connector socket assembly mounted to an insulative housing for mating with a conductive connector pin of a complementary connector. The socket assembly comprises a base member and a conductive socket member mounted to the base member and which is adapted to receive the connector pin. The socket member is generally tubular with a longitudinal axis, is open at its end remote from the base member, and is formed with a plurality of elongated fingers extending longitudinally from a region adjacent the base member to the open remote end to define a compliant receptacle for the connector pin which is adaptive to variations in the diameter of the pin. The socket assembly further comprises mounting means for mounting the base member to the housing in such a manner as to allow limited freedom of movement of the base member relative to the housing orthogonally of the longitudinal axis of the socket member. Thus, variations in the location of the pin are accommodated.

In accordance with an aspect of this invention, the location of the mounting of the base member to the housing is such that the lengths of the elongated fingers of the socket member are maximized within the design constraints of the housing. This results in a low insertion force when the pin enters the socket member.

In accordance with another aspect of this invention, the base member includes a mounting bore and the mounting means comprises a pin extending through the mounting bore and fixedly secured to the housing. The mounting pin is smaller than the mounting bore to allow limited freedom of movement of the base member relative to the housing orthogonally of the longitudinal axis of the socket member.

In accordance with a further aspect of this invention, a connector assembly is provided which includes a pair of socket assemblies of the type described above. This connector assembly is adaptive to variations both in the spacing between the pins of the mating connector and in the diameters of the pins.

BRIEF DESCRIPTION OF THE DRAWINGS

The foregoing will be more readily apparent upon reading the following description in conjunction with the drawings in which like elements in different figures thereof are identified by the same reference numerals and wherein.

DETAILED DESCRIPTION

Figure 1:
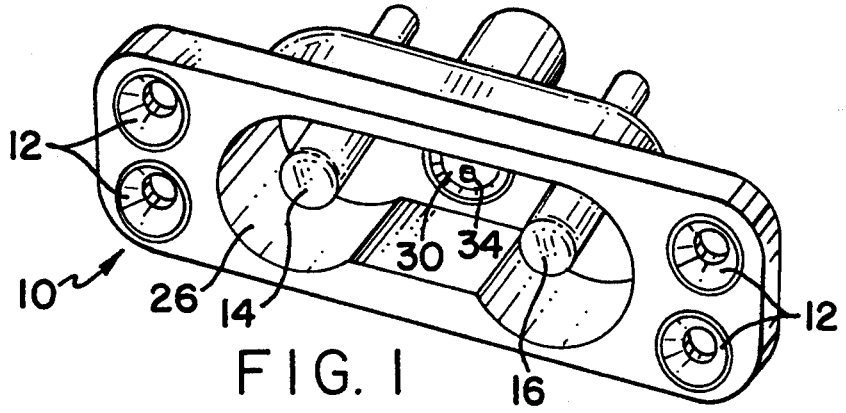
FIG. 1 is a perspective view of an illustrative pin receptacle of the type with which the inventive connector mates.

FIG. 1 illustrates a battery receptacle, designated generally by the reference numeral 10, of the type with which the inventive connector is adapted to mate. The receptacle 10 is designed for mounting on a battery (not shown) by means of the mounting holes 12 and includes conductive pins 14 and 16 which are each connected to a respective one of the positive and negative battery terminals. The specifications for the receptacle 10 include nominal diameters for the pins 14 and 16 as well as a nominal spacing between the pins 14 and 16. However, as with all manufactured parts, the specified nominal dimensions are subject to variation, which is allowable within a prescribed tolerance. The electrical connector assembly constructed in accordance with this invention adapts to these dimensional variations.

Figure 2:
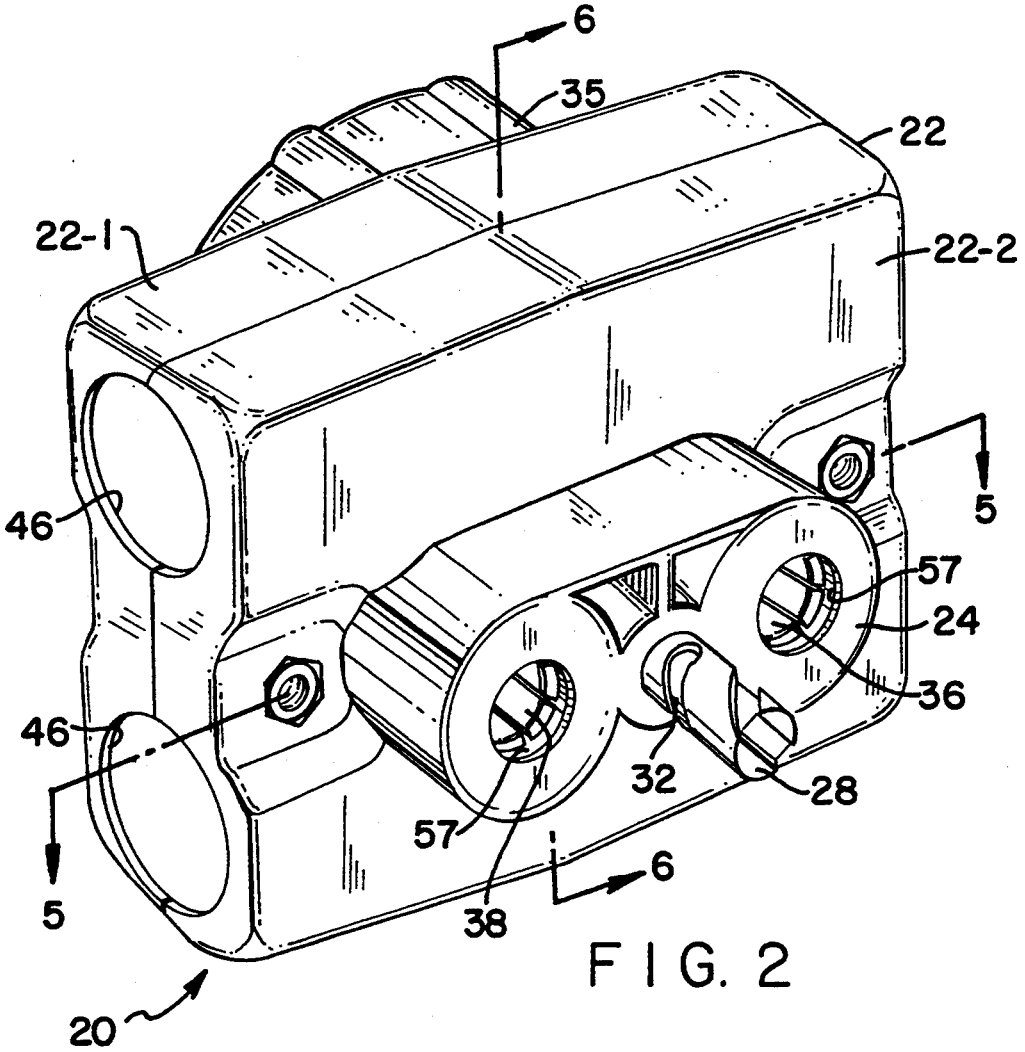
FIG. 2 is a perspective view of a quick disconnect electrical connector assembly constructed in accordance with the principles of this invention.

FIG. 2 illustrates a connector assembly, designated generally by the reference numeral 20, constructed in accordance with the principles of this invention, for mating with the receptacle 10. The connector assembly 20 includes an insulative housing 22 formed as two parts 22-1 and 22-2 joined along a plane. The housing 22 has a mating projection 24 adapted for insertion into a complementary recess 26 of the receptacle 10. The projection 24 and the recess 26 are keyed so that they can be mated in only one way. This insures retention of the appropriate polarity. The shaft 28 of the connector 20 is adapted for insertion into the cavity 30 of the receptacle 10. As shown, the shaft 28 is formed with a pair of diametrically opposed helical grooves 32 which mate with diametrically opposed pins 34 within the cavity 30. Accordingly, when the shaft 28 is inserted into the cavity 30 and turned in a first direction by the knob 35 on the other side of the housing 22, the projection 24 is drawn into the recess 26. Conversely, when the shaft 28 is turned in the opposite direction, the projection 24 is withdrawn from the recess 26. This arrangement of the shaft 28 and the cavity 30 and pins 34 provides the "quick disconnect" feature, which is well known in the art and forms no part of the present invention.

Figure 3:
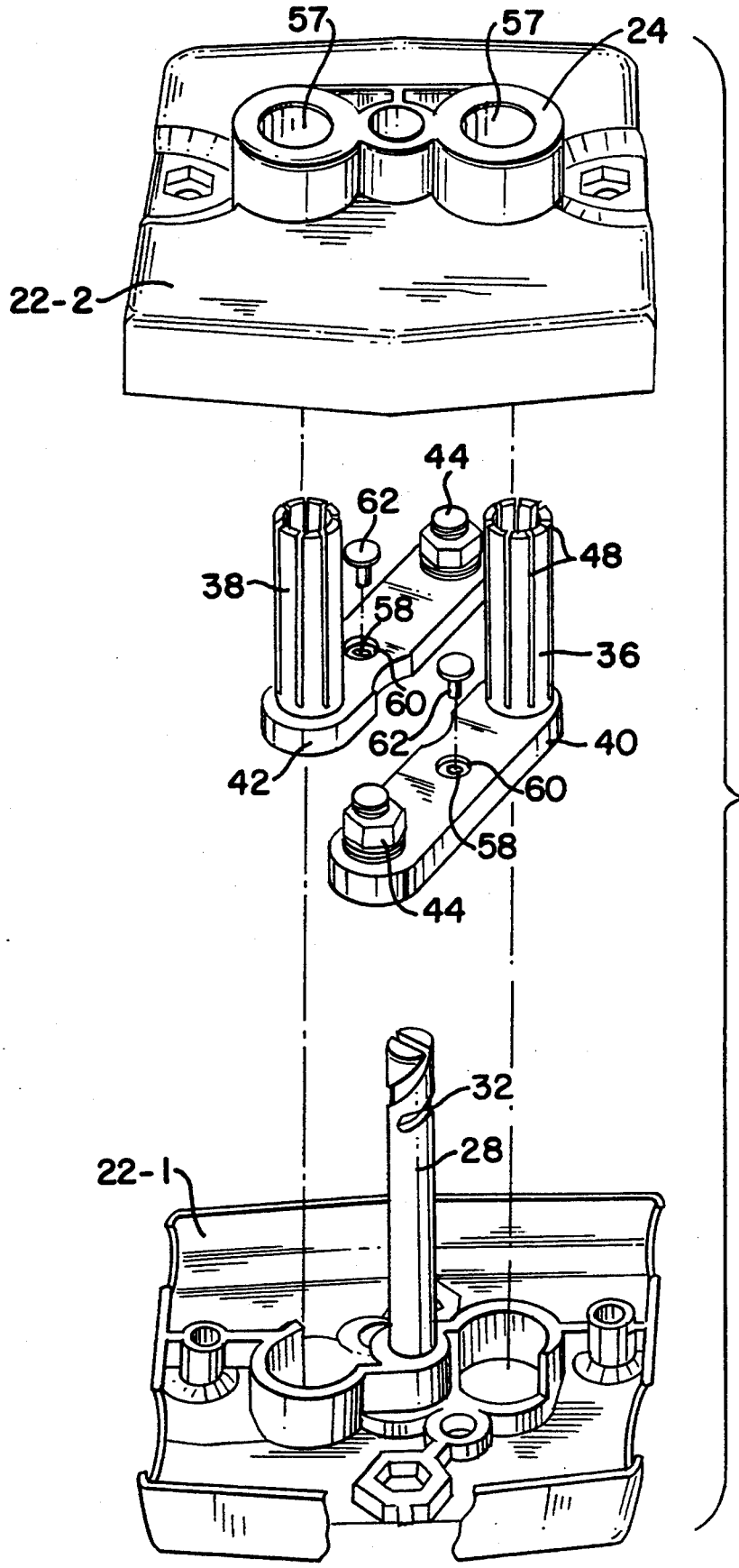
FIG. 3 is an exploded perspective view, partially broken away, of the connector assembly shown in FIG. 2.

As will be described in full detail hereinafter, the socket members 36 and 38 are mounted within the housing 20 for mating with the pins 14 and 16, respectively. As shown in FIG. 3, each of the socket members 36, 38 is mounted to a respective base member 40, 42. Each of the base members 40, 42 is formed of relatively thick conductive sheet stock material. At one end of each base member there is mounted a terminal assembly 44, illustratively comprising a bolt, a nut and several washers. The bolt of the terminal assembly 44 extends through an aperture provided therefor through the base member. Wires (not shown) which extend through openings 46 in the housing 22 from the wiring harness are connected to the terminal assembly 44 and, through the terminal assembly 44, the base member 40 and the socket member 36, are connected to an appropriate battery terminal.

Figure 4:
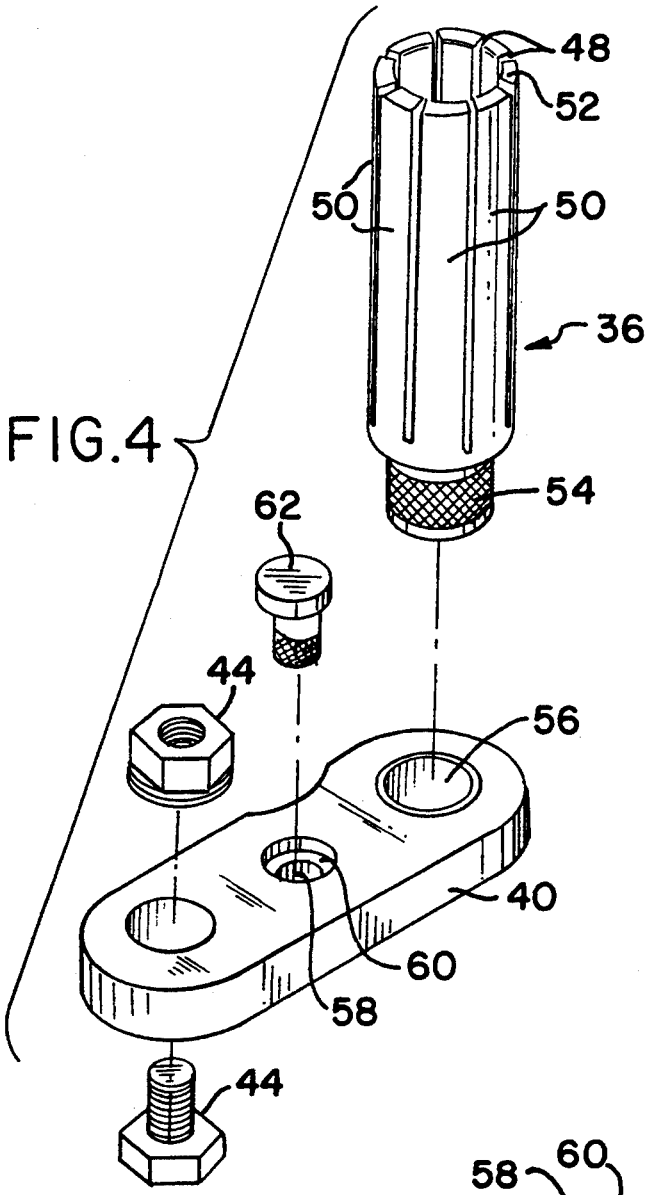
FIG. 4 is an exploded perspective view of the socket assembly of the connector assembly shown in FIG. 2.

Referring to FIG. 4, the socket member 36 is preferably machined from a solid circular cross section of copper alloy into the configuration shown. The interior diameter of the socket member 36 is dimensioned to be equal to or slightly smaller than the minimum diameter of the pins 14, 16. Longitudinal slots 48 are machined into the socket member 36 to form a plurality of elongated fingers 50, which terminate at the open end 52 of the socket member 36. The socket member 36 is also formed with a reduced diameter, and preferably knurled, portion 54 at the end remote from the open end 52. The base member 40 is formed with a bore 56 remote from the terminal assembly 44, the diameter of the bore 56 being such that the knurled portion 54 of the socket member 36 may be press fit therein. After being press fit into the bore 56, the reduced diameter portion 54 is swaged to assure a firm and secure mounting of the socket member 36 to the base member 40. This mounting is such that after the base members 40, 42 are installed in the housing 22, the longitudinal axes of the socket members 36, 38 are parallel to each other. After such installation, the open ends 52 of the socket members 36, 38 are accessible through openings 57 in the projection 24, as is clear from FIG. 2.

It is desired that the lengths of the elongated fingers 50 be maximized. This results in several benefits, as will be apparent from the following discussion. Deflection of the fingers 50 upon entry of the pin 14 into the socket member 36 results in a bending stress being imparted to each of the fingers 50. This stress is a function of the amount of deflection, the cross section of the finger, the type of material and, importantly, the length of the finger. It turns out that the developed stress is inversely proportional to the square of the finger length. When the fingers 50 engage a pin 14 having the maximum allowable diameter, or if structural loads develop which cause relative motion of the pin/socket, by maximizing the length of the fingers, the stress level remains at a low enough value within the elastic limits of the fingers that no permanent deformations of the fingers occur. This allows for repeated insertions in which the socket fingers deflect outward but return to their original positions when disengaged. During engagement, the fingers 50 develop a force on the pin 14 that ensures electrical contact throughout the life of the part.

Figure 8:
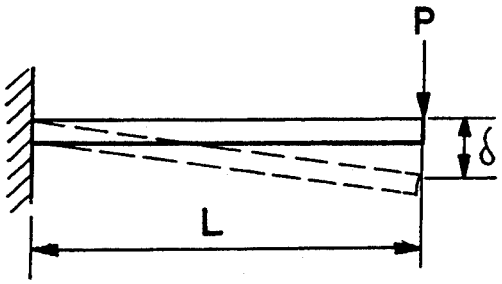
FIG. 8 is a simplified beam deflection diagram useful for understanding the principles of this invention.
Figure 5:
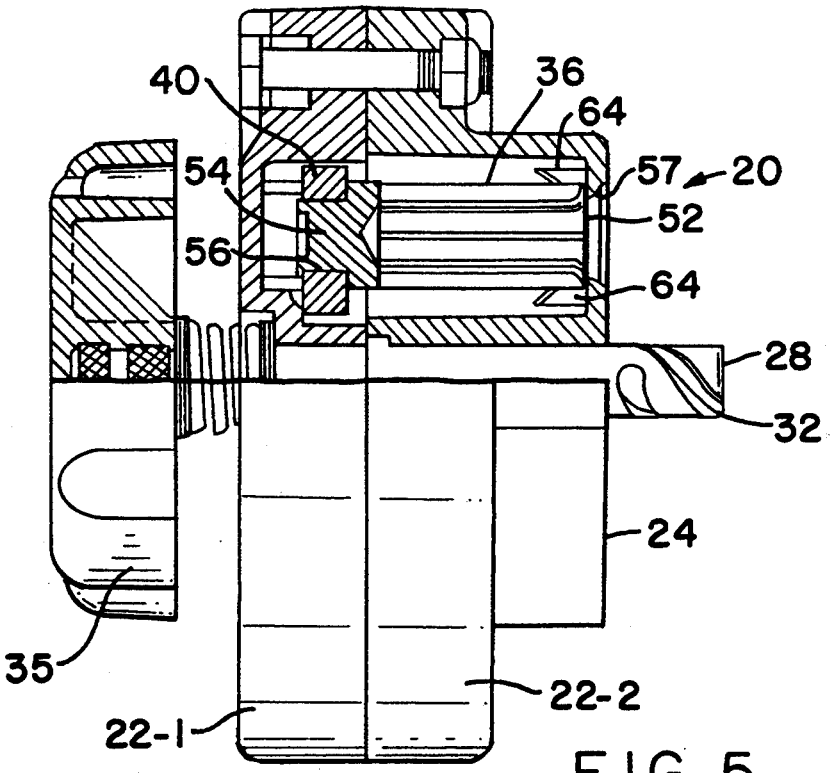
FIG. 5 is a partial cross sectional view taken along the line 5—5 in FIG. 2.
Figure 6:
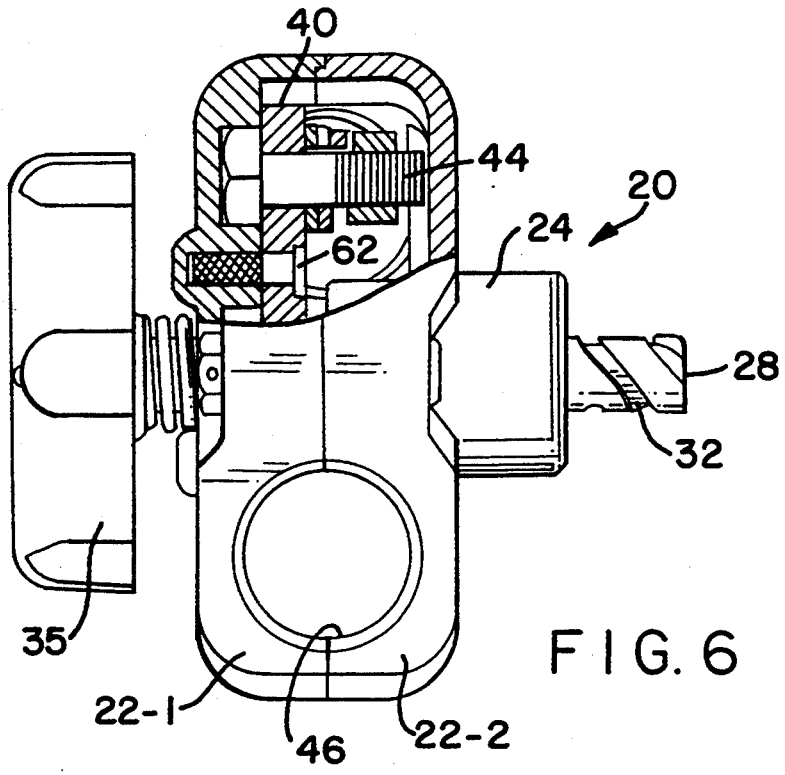
FIG. 6 is a partial cross sectional view taken along the line 6—6 in FIG. 2.

As shown in FIG. 8, for a beam having a length L and having an applied orthogonal force P, the deflection 6 of the beam can be expressed as follows:

$$\delta = PL^3/3EI;$$

where E is the modulus of elasticity of the beam material and I is the cross sectional moment of inertia of the beam. In the case of the socket member 36, the deflection of the fingers 50 is caused by the pin 14 having an outer diameter greater than the inner diameter of the socket member, with the force P being caused by the pin being inserted into the socket member. The beam has to withstand a bending moment M which is equal to the load P times the length of the beam (i.e., M=PL). The stress developed in the beam is then:

$$S = Mc/I = PLc/I;$$

where c is the distance from the neutral axis of the beam to the outer fiber of the beam. In the case of the simple elongated fingers 50, c is equal to one half the thickness of the fingers. Combining the previous equations results in:

$$PL = 3EI\delta/L^2 = SI/c, \text{ so that:}$$

$$S = 3E\delta c/L^2.$$

Accordingly, for a given deflection, the stress is inversely proportional to the square of the beam length. Thus, it is desirable to maximize the lengths of the fingers 50. According to this invention, this is accomplished by extending the slits 48 from the open end 52 to a region adjacent the base member 40. In addition, the base member 40 is mounted to the housing part 22-1, rather than to the housing part 22-2, so that it is as far away from the mating projection 24 as design constraints of the connector assembly 20 allow.

Another benefit derived from maximizing the length of the fingers 50 will be understood by reviewing the first equation and solving for the load P, as follows:

$$P = \delta 3EI/L^3.$$

The load P is the force developed on the finger 50 as a result of a deflection of the finger 50 by an amount equal to δ. It is equal and opposite in direction to the force exerted on the pin 14 by the finger 50. Multiplying this force by the coefficient of friction between the pin and the socket is equal to the insertion force. Accordingly, the insertion force is inversely proportional to the cube of the finger length. Thus, the benefits obtained by maximizing the length of the socket fingers 50 are low insertion force and reduced wear between the surfaces of the pin/socket interface, since the insertion force is significantly smaller than it would have been had the socket assembly been mounted in the housing part 22-2. The reduced wear improves the life of the assembly and insures that the connector assembly 20 will meet the specified contact resistance requirements throughout its life.

Figure 7:
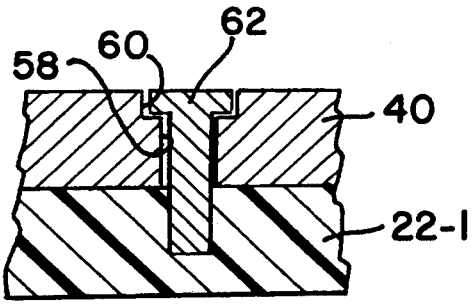
FIG. 7 is an enlarged portion of the cross sectional view of FIG. 6.

As discussed above, another feature of the inventive connector 20 is its adaptability for variations in the spacing between the pins 14 and 16. This adaptability is accomplished by mounting the base members 40, 42 to the housing part 22-1 in such a manner that they "float" orthogonally to the longitudinal axes of the socket members 36, 38. Thus, each base member 40, 42 is formed with a mounting bore 58 which is counterbored so as to have an enlarged region 60, the mounting bore 58 having a longitudinal axis parallel to the longitudinal axis of the respective socket member 36, 38. Mounting of the socket assembly is effected by providing a headed mounting pin 62 having a diameter along its length which is less than the internal diameter of the mounting bore 58 so that, as is clear from FIG. 7, there is a gap between the sides of the mounting pin 62 and the mounting bore 58 which allows the base member 40 to have a limited freedom of movement relative to the mounting pin 62. The mounting pin 62 is press fit into an appropriate opening therefor in the housing part 22-1 and secured therein as by adhesive or ultrasonic welding. The head of the mounting pin 62 limits movement of the base member 40 in a direction parallel to the longitudinal axis of the socket member 36.

The pins 14, 16 and the fingers 50 all have rounded (radiused) ends so that as a pin enters a socket member, the smaller radius pin end freely enters the socket member and then aligns the socket member to the proper spacing. This alignment of a socket member is limited by the gap between the mounting pin 62 and the inner diameter of the mounting bore 58. Since the mounting pin 62 allows the base member 40, 42 to rotate, such rotation is limited by interference of the socket assembly with the housing. Thus, the ribs 64 surrounding the openings 57 of the projection 24 limit movement of the socket members 36, 38 so that the mating pins 14, 16 always engage the interiors of the socket members. This self-aligning feature provides the following benefits:

1. reduced deflection of the socket member fingers caused by variations in the location of the pin to the socket member;
2. reduced wear at the pin/socket member interface since the deflection and consequently the insertion force is reduced; and
3. low insertion force since the socket member now only has to accommodate diametrical variations of the pin.

Accordingly, there has been disclosed an improved electrical connector assembly which is adaptive to accommodate variations in the spacing between, and in the diameters of, pins with which it mates. It is understood that the above-described embodiment is merely illustrative of the application of the principles of this invention. Numerous other embodiments may be devised by those skilled in the art without departing from the spirit and scope of this invention, as defined by the appended claims.

What is claimed is:

1. A dimensional tolerant electrical connector socket assembly mounted to an insulative housing for mating with a conductive connector pin of a complementary connector, said socket assembly comprising:

a base member;

a conductive socket member fixedly mounted to said base member and adapted to receive said connector pin, said socket member being generally tubular with a longitudinal axis and open at its end remote from said base member, the internal diameter of said socket member being no larger than the minimum diameter of said connector pin, said socket member being formed with a plurality of elongated fingers extending longitudinally from a region adjacent said base member to said open remote end to define a compliant receptacle for said connector pin; and mounting means for mounting said base member to said housing in such a manner as to allow limited freedom of movement of said base member relative to said housing orthogonally of the longitudinal axis of said socket member;

wherein said base member is formed with a mounting bore having an axis parallel to the longitudinal axis of said socket member and said mounting means comprises a mounting member extending through said mounting bore and fixedly secured to said housing, said mounting member having a cross section dimensioned smaller than the cross section of said mounting bore along the entire length of said mounting member and said mounting bore to allow limited freedom of movement of said base member relative to said housing orthogonally of the longitudinal axis of said socket member.

2. The assembly according to claim 1 wherein said housing is formed in two parts joined along a plane orthogonal to the longitudinal axis of said socket member with a first of said housing parts having an opening through which the open end of said socket member is accessible to receive said connector pin, and said mounting means secures said base member to the other of said housing parts.

3. The assembly according to claim 1 wherein said mounting bore includes an enlarged region at the end of said mounting bore remote from said housing, and said mounting member includes a pin having an enlarged head adapted to be received in said mounting bore enlarged region, whereby said mounting member limits movement of said base member in a direction parallel to the longitudinal axis of said socket member.

4. The assembly according to claim 1 wherein each of said fingers is rounded at said open remote end to allow easy entry of said connector pin into said socket member.

5. An electrical connector assembly for mating with a complementary connector having a pair of fixedly mounted and spaced apart parallel conductive pins, the connector assembly comprising:

an insulative housing;

a pair of base members;

a pair of conductive socket members each fixedly mounted to a respective one of said base members and adapted to receive a respective one of said pins, each of said socket members being generally tubular with a longitudinal axis, the internal diameter of each of said socket members being no larger than the minimum diameter of the respective one of said pins, the longitudinal axes of said pair of socket members being substantially parallel to each other, each of said socket members being open at its end remote from the respective base member and said each socket member being formed with a plurality of elongated fingers extending longitudinally from a region adjacent said respective base member to its open remote end to define a compliant receptacle for the respective one of said pins; and mounting means for mounting each of said base members to said housing in such a manner as to allow limited freedom of movement of said base members relative to said housing orthogonally of the longitudinal axis of each of said socket members;

wherein each of said base members is formed with a respective mounting bore having an axis parallel to the longitudinal axis of the respective one of said socket members and each of said mounting means comprises a respective mounting member extending through the respective mounting bore and fixedly secured to said housing, each of said mounting members having a cross section dimensioned smaller than the cross section of the respective mounting bore along the entire length of said each mounting member and the respective mounting bore to allow limited freedom of movement of the respective base member relative to said housing orthogonally of the longitudinal axis of the respective socket member;

whereby the spacing between said socket members can adapt to variations in the spacing between said pins and the internal diameters of said socket members can adapt to variations in the diameters of said pins.

6. The assembly according to claim 5 wherein said housing is formed in two parts joined along a plane orthogonal to the longitudinal axes of said socket members with a first of said housing parts having a pair of openings through each of which the open end of a respective one of said socket members is accessible to receive a respective one of said pins, and each of said mounting means secures the respective one of said base members to the other of said housing parts.

7. The assembly according to claim 5 wherein each of said mounting bores includes an enlarged region at the end of said each mounting bore remote from said housing, and each of said mounting members includes a pin having an enlarged head adapted to be received in the respective mounting bore enlarged region, whereby the respective mounting member limits movement of the respective base member in a direction parallel to the longitudinal axis of the respective socket member.

8. The assembly according to claim 5 wherein each of said fingers is rounded at the open remote end of its respective socket member to allow easy entry of the respective one of said pins into said respective socket member.

* * * * *